US006766033B2

(12) United States Patent
Jorgensen et al.

(10) Patent No.: US 6,766,033 B2
(45) Date of Patent: Jul. 20, 2004

(54) MODULAR BASS ARRAYING

(75) Inventors: Morten Jorgensen, Southborough, MA (US); Christopher B. Ickler, Sudbury, MA (US)

(73) Assignee: Bose Corporation, Framingham, MA (US)

( * ) Notice: Subject to any disclaimer, the term of this patent is extended or adjusted under 35 U.S.C. 154(b) by 173 days.

(21) Appl. No.: 09/955,699

(22) Filed: Sep. 19, 2001

(65) Prior Publication Data

US 2003/0053648 A1 Mar. 20, 2003

(51) Int. Cl.[7] ..... H04R 1/02; H04R 25/00; H04R 29/00

(52) U.S. Cl. ..... 381/387; 381/182; 381/87; 381/89; 381/59

(58) Field of Search ..... 381/182, 387, 381/89, 87, 332, 59

(56) References Cited

U.S. PATENT DOCUMENTS 5,852,545 A 12/1998 Pan-Ratzlaff ..... 361/683
6,480,613 B1 * 11/2002 Choi ..... 381/386

* cited by examiner

*Primary Examiner*—F. W. Isen
*Assistant Examiner*—Elizabeth McChesney

(74) *Attorney, Agent, or Firm*—Fish & Richardson P.C.

(57) ABSTRACT

A modular audio loudspeaker array system. The system includes a first speaker module, and a second speaker module, constructed and arranged to radiate sound waves responsive to audio signals. Sound waves radiated by the first speaker module and the sound waves radiated by the second speaker module combine to form a radiation pattern. The system further includes a positioning system, for positioning the first bass module relative to the second bass module at a plurality of fixed predetermined distances; an audio signal input terminal electronically for coupling the loudspeaker array to a source of the audio signals for receiving the audio signals; an audio signal processing device, electronically coupling the audio signal input terminal to the first bass module and to the second bass module, for processing the audio signals and transmitting the audio signals to the first speaker module and to the second loudspeaker module. The audio signal processing device is constructed and arranged to apply a first signal processing parameter value to the audio signals transmitted to the first loudspeaker module and a second signal processing parameter value to the audio signals transmitted to the second loudspeaker module so that the first parameter value and the second parameter value differ by a parameter value difference. The system further includes a processing parameter selection device, comprising a plurality of preset indicators, each of the preset indicators corresponding to a predetermined parameter value difference, wherein the predetermined parameter value difference and a one of the plurality of predetermined distances corresponds to a predetermined radiation pattern.

8 Claims, 4 Drawing Sheets

MODULAR BASS ARRAYING

CROSS-REFERENCE TO RELATED APPLICATIONS

There is no applications related to the present one.

STATEMENT REGARDING FEDERALLY SPONSORED RESEARCH OR DEVELOPMENT

The subject matter of this application is not related to any federally sponsored research or development.

TECHNICAL FIELD

This invention relates to audio bass arrays, and more particularly to modular bass arrays.

BACKGROUND OF THE INVENTION

It is an important object of the invention to provide a modular bass array with preset physical configurations and preset signal processing parameter settings.

BRIEF SUMMARY OF THE INVENTION

According to the invention, an audio loudspeaker array system includes a first speaker module, and a second speaker module, constructed and arranged to radiate sound waves responsive to audio signals. The sound waves radiated by the first speaker module and the sound waves radiated by the second speaker module combine to form a radiation pattern. The audio array further includes a positioning system, for positioning the first bass module relative to the second bass module at one a plurality of fixed predetermined distances, an audio signal input terminal electronically for coupling the loudspeaker array to a source of the audio signals for receiving the audio signals, and an audio signal processing device, electronically coupling the audio signal input terminal to the first bass module and to the second bass module. The audio signal processor processes the audio signals and transmits the audio signals to the first speaker module and to the second loudspeaker module. The audio signal processing device is constructed and arranged to apply a first signal processing parameter value to the audio signals transmitted to the first loudspeaker module and a second signal processing parameter value to the audio signals transmitted to the second loudspeaker module so that the first parameter value and the second parameter value differ by a parameter value difference. The audio loudspeaker further includes a processing parameter selection device, comprising a plurality of preset indicators, each of the preset indicators corresponding to a predetermined parameter value difference. The predetermined parameter value difference and a one of the plurality of predetermined distances corresponds to a predetermined radiation pattern.

In another aspect of the invention, an audio loudspeaker array, includes a first module comprising an electroacoustical transducer and an enclosure having a width a depth and a height, a second module comprising a loudspeaker and an enclosure, and a positioner for positioning the first module at a fixed distance from the second module, wherein the fixed distance is greater than twice the smallest of the width, the depth and the height.

In still another aspect of the invention, n audio loudspeaker array for radiating bass frequencies, includes a first module comprising an electroacoustical transducer and an enclosure, a second module comprising a loudspeaker and an enclosure, and a positioner for positioning the enclosure of the first module at a fixed distance from the enclosure of the second module, wherein the fixed distance is greater than half the shortest wavelength sound intended to be radiated by the array.

Other features, objects, and advantages will become apparent from the following detailed description, which refers to the following drawings in which:

DETAILED DESCRIPTION

Figure 1:
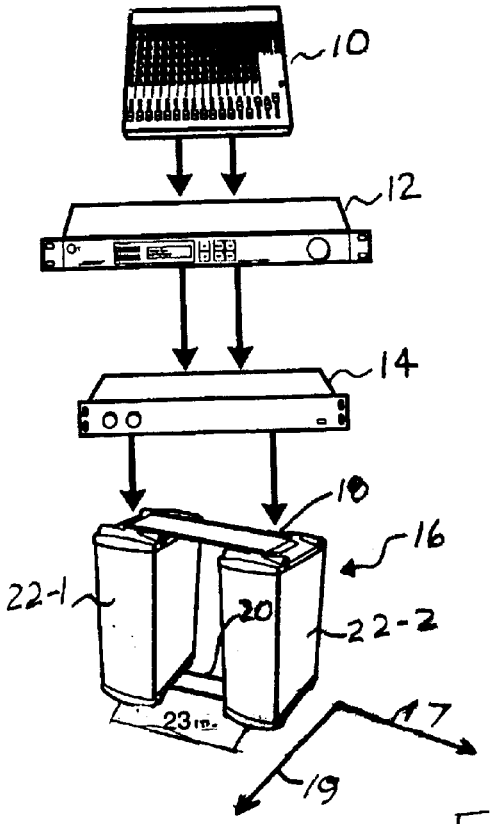
FIG. 1 is a diagrammatic view of an audio system according to the invention.

With reference now to the drawings and more particularly to FIG. 1, there is shown a diagrammatic view of the bass reproduction portion of an audio system according to the invention. A source of bass audio signals (hereinafter audio signal source) 10, such as a mixer, is coupled to audio signal processor 12. Audio signal processor 12 is coupled to bass array 16, through amplifier 14. Bass array 16 includes first bass module 22-1 and second bass module 22-2, which are held in a horizontally displaced position relative to each other by brackets 18 and 20.

Audio signal source 10 may be a conventional professional mixer. System controller 12 may be a Panaray® System Digital Controller, available commercially from Bose Corporation of Framingham, Mass. Amplifier 14 may be a conventional amplifier with at least two input terminals and at least two output terminals. Bass modules 22-1 and 22-2 may be Panaray® MB4 Modular Bass Loudspeakers (each of which comprise four six inch drivers, which have enclosure dimensions of 15.0 inches deep by 9.0 inches wide by 26.0 inches high, and which are substantially omnidirectional below 300 Hz), and brackets 18 and 20 may be MB4 Endfire 2X Bass Array Brackets, all available commercially from Bose Corporation of Framingham, Mass.

In operation, audio signal source transmits audio signals to audio signal processor 12. Audio signal processor 12 decodes the audio signals to produce processed audio signal, which may include a bass audio signal. Audio signal processor outputs the bass audio signal as two channels, with different signal processing parameter values applied to the two channels. Parameters for which different processing values may be applied include magnitude equalization, phase equalization, time delay, phase, and magnitude, or some combination of those parameters. For simplicity, the invention will be described using time delay as the parameter for which different values are applied to the two channels. Different values (which may be zero) of time delay can be applied to the two channels so that the two channels are separated in time by time delay $\Delta T$. Amplifier 14 amplifies the two channels or bass audio signals and outputs the amplified audio signals to bass modules 22-1 and 22-2, still separated in time by time delay ΔT. Bass modules 22-1 and 22-2 transduce the audio signals to sound waves. The resultant sound field is shown in FIG. 2, with zero degree represented by direction 17 connecting the acoustical centers of bass modules 22-1 and 22-2 and 90 degrees represented by direction 19, orthogonal to direction 17 in the horizontal plane.

Figure 2:
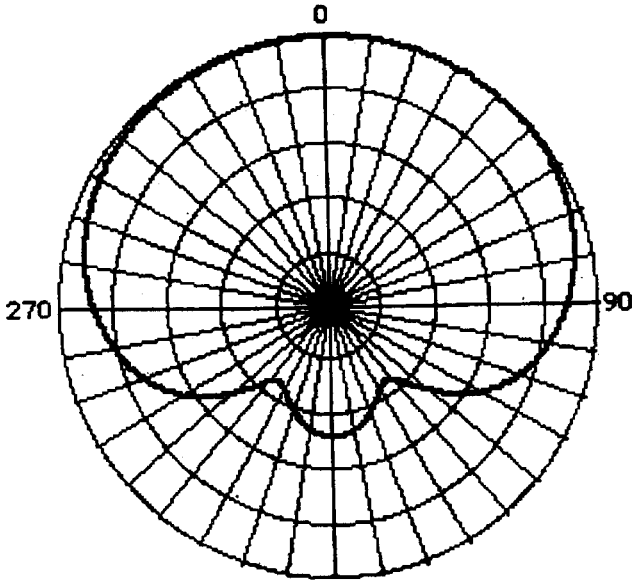
FIG. 2 is a polar plot of the radiation pattern of the embodiment of FIG. 1.

Referring now to FIG. 2, there is shown a polar plot showing the radiation pattern taken at 160 Hz of the audio system of FIG. 1, with a time delay ΔT of 1.71 ms, a center to center distance d between bass modules of 23 inches, which is greater than half the shortest wavelength intended to be reproduced (300 Hz, wavelength of about 3.8 feet) and more than twice the width (the smallest linear dimension) of the enclosure. The radiation pattern is determined principally by the distance d between the bass modules and by the value of time delay ΔT. If one or both of the bass modules are not omnidirectional, the radiation pattern may also be affected by the relative orientation of the bass modules. If the bass modules are directional in the frequency range radiated, brackets 18 and 20 may be adapted to fix the orientation or the two modules, as well as fixing the spacing.

The value of time delay ΔT may be entered by manually, or, more conveniently through the use of preset indicators on system controller 12. In one implementation of the invention, one of the preset indicators is pre-programmed to delay the audio signal to bass module 22-1 relative to the audio signal to bass module 22-2 so that the radiation responsive to the audio signal from bass module 22-2 is radiated 1.7a ms. later than the corresponding radiation from bass module 22-1. Thus, if a user desires a maximum acoustic output as of 116 dB SPL, with a radiation pattern as shown in FIG. 2, the user can assemble a bass array as shown in FIG. 1, and select a preset setting.

Figure 3:
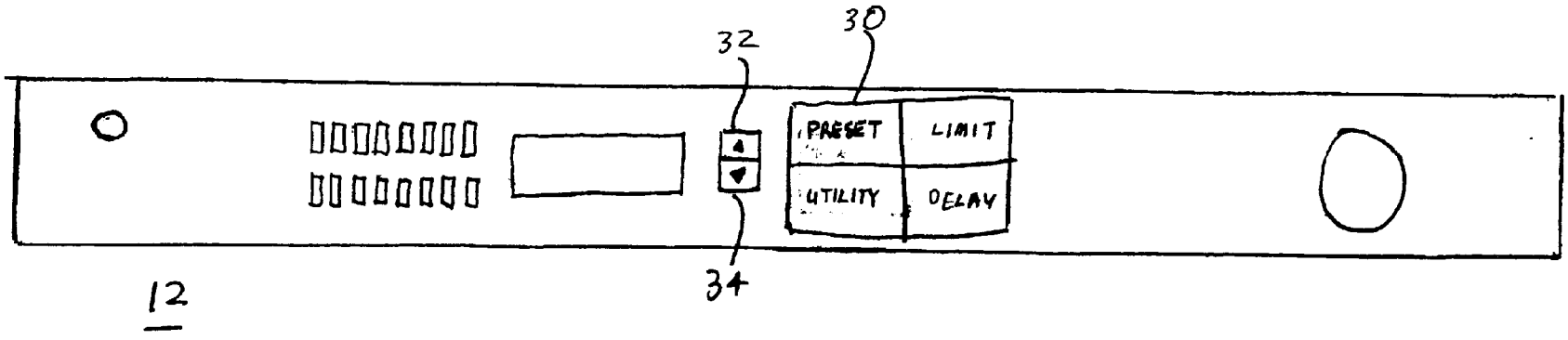
FIG. 3 is front view of a control panel of a system controller for the embodiment of FIG. 1.

Referring to FIG. 3, there is shown the control panel of system controller 12. Preset indicator may be selected by entering the "Preset" button 30 and the up and down indicators, 32 and 34 respectively. Other system controllers may have different preset selector arrangements, such as discrete programmable manual pushbuttons, touchscreens, or display screens using selector indicators such as computer mouses.

An audio system according to the invention is advantageous because it provides a bass array that can radiate a predetermined radiation pattern with less setup time than conventional bass arrays. A bass array according to the invention is particularly advantageous for sound systems for portable applications that must provide high amounts of acoustic output, and must be set up quickly. The components of the array can be transported and stored separately. The array can be assembled in the correct physical configuration quickly, and the correct time delay can be input easily and without the user having to record or memorize the appropriate time delay interval.

Figure 4:
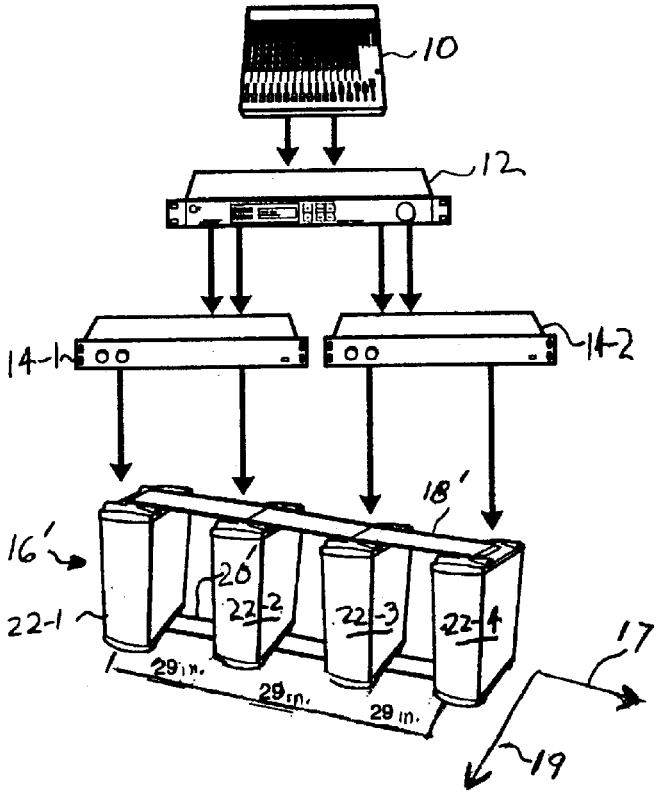
FIG. 4 is a diagrammatic view of a second embodiment of the invention.

Referring to FIG. 4, there is shown a diagrammatic view of the bass reproduction portion of a second audio system according to the invention. A source of bass audio signals (hereinafter audio signal source) 10, such as a mixer, is coupled to audio signal processor 12. Audio signal processor 12 is coupled to bass array 16', through amplifiers 14-1 and 14-2. Bass array 16' includes first bass module 22-1 second bass module 22-2, third bass module 22-3, and fourth bass module 22-4, which are held in position in a horizontal line relative to each other by brackets 18' and 20'.

Audio signal source 10 may be a conventional professional mixer. System controller 12 may be a Panaray™ System Digital Controller, available commercially from Bose Corporation of Framingham, Mass. Amplifiers 14-1 and 14-2 may be conventional amplifiers with at least two input terminals and at least two output terminals. Bass modules 22-1, 22-2, 22-3, and 22-4 may be Panaray® MB4 Modular Bass Loudspeakers (which are substantially omnidirectional below 300 Hz), and brackets 18', and 20' may be MB4 Endfire 4X Bass Array Brackets, all available commercially from Bose Corporation of Framingham, Mass.

Figure 5:
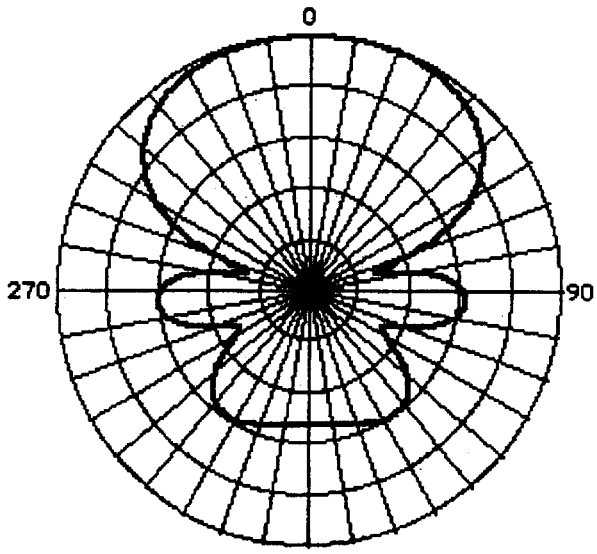
FIG. 5 is a polar plot of the radiation pattern of the embodiment of FIG. 4.

Referring to FIG. 5, there is shown a polar plot showing the radiation pattern taken at 160 Hz of the audio system of FIG. 4, with a time delay ΔT between bass modules 22-1 and 22-2 of 2.15 ms, between bass modules 22-2 and 22-3 of 2.00 ms, between bass modules 22-3 and 22-4 of 2.15 ms, and a center to center distance d between bass modules of 29 inches. The radiation pattern is determined principally by the distance d between the bass modules and by the value of time delay ΔT . If one or both of the bass modules are not omnidirectional, the radiation pattern may also be affected by the relative orientation of the bass modules.

As described in the discussion of FIG. 3, one of the preset buttons can be pre-programmed to apply the appropriate time delay to result in the radiation pattern of FIG. 4. The embodiments of FIGS. 4 and 5 illustrate an additional advantage of the invention. Since the components of the audio system of FIGS. 1–3 (except for brackets 18 and 20) are all included in the audio system of FIGS. 4 and 5, the audio system of FIGS. 4 and 5 could be easily converted to the audio system of FIGS. 1–3 by the substitution of the brackets 18 and 20 for brackets 18' and 20' and by selecting a preset setting on the system controller 12.

Figure 6:
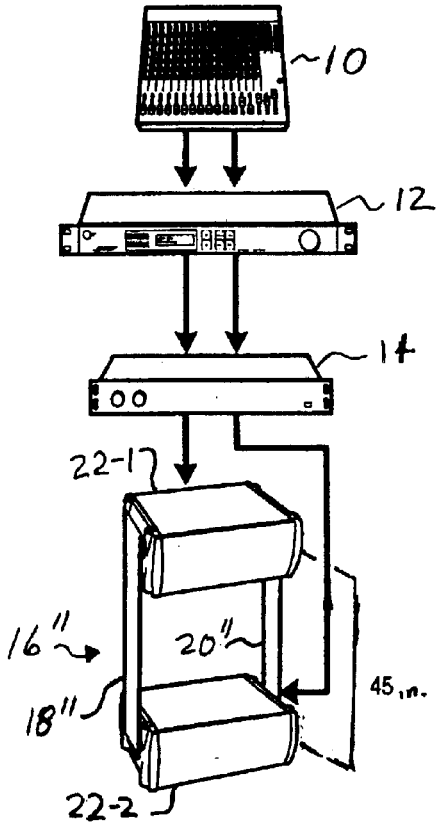
FIG. 6 is a diagrammatic view of a third embodiment of the invention.

Referring now to FIG. 6, there is shown a diagrammatic view of the bass reproduction portion of a third audio system according to the invention. A source of bass audio signals (hereinafter audio signal source) 10, such as a mixer, is coupled to audio signal processor 12. Audio signal processor 12 is coupled to bass array 16" through amplifiers 14-1 and 14-2. Bass array 16" includes first bass module 22-1 and second bass module 22-2, which are held in a vertically displaced relationship to each other by brackets 18" and 20".

Figure 7:
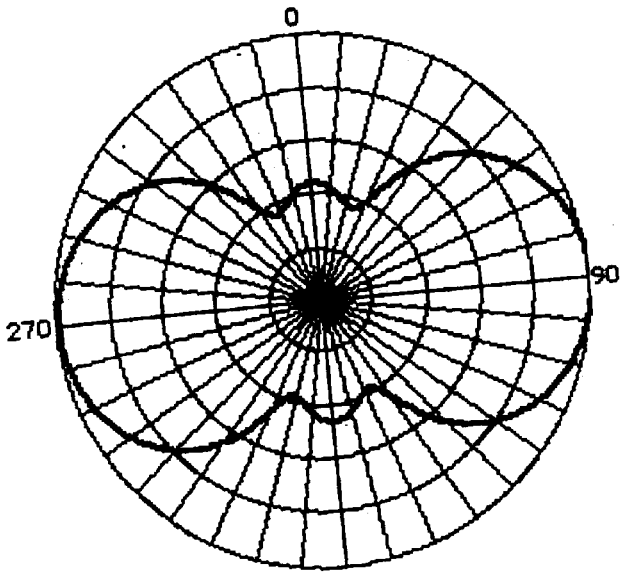
FIG. 7 is a polar plot of the radiation pattern of the embodiment of FIG. 6.

Referring now to FIG. 7, there is shown a polar plot showing the vertical radiation pattern taken at 160 Hz of the audio system of FIG. 1, with a time delay ΔT of zero, a vertical distance d between bass modules of 45 inches. The horizontal dispersion is substantially omnidirectional. The vertical radiation pattern is determined principally by the distance d between the bass modules and by the value of time delay ΔT . If one or both of the bass modules are not omnidirectional, the vertical radiation pattern may also be affected by the relative orientation of the bass modules.

The components of the audio system of FIGS. 6 and 7 are identical to the components of the audio system of FIGS. 1–3, except for brackets 18 and 20. The audio system of FIGS. 1–3 could be converted to the audio system of FIGS. 5 and 6 by replacing brackets 18" and 20" with brackets 18 and 20 and selecting the appropriate preset setting on the system controller 12.

As stated above in the discussion of FIG. 1, the invention may be practiced using parameters other than time delay, such as signal magnitude; phase delay; or phase response (frequency dependent amplitude), or by using any of the logical combinations of the parameters. A preset indicator could, for example, correspond to a specific time delay difference between the audio signals transmitted to two modules and also to a different equalization pattern applied to the two audio signals transmitted to the two modules. The radiation pattern resulting from time delay difference, the equalization pattern difference, and the distance (and orientation if the modules are not omnidirectional) can be determined by computer simulation or by actual measurement. The use of a single preset indicator setting is especially advantageous when used to specify more than one parameter setting, because the selection of a single preset setting can fix the values of multiple parameters.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

What is claimed is:

1. An audio loudspeaker array system, comprising, a first speaker module, and a second speaker module, constructed and arranged to radiate sound waves responsive to audio signals, wherein said sound waves radiated by said first speaker module and said sound waves radiated by said second speaker module combine to form a radiation pattern;

a positioning system, for positioning said first bass module relative to said second bass module at a plurality of fixed predetermined distances;

an audio signal input terminal electronically for coupling said loudspeaker array to a source of said audio signals for receiving said audio signals;

an audio signal processing device, electronically coupling said audio signal input terminal to said first bass module and to said second bass module, for processing said audio signals and transmitting said audio signals to said first speaker module and to said second loudspeaker module, said audio signal processing device constructed and arranged to apply a first signal processing parameter value to said audio signals transmitted to said first loudspeaker module and a second signal processing parameter value to said audio signals transmitted to said second loudspeaker module so that said first parameter value and said second parameter value differ by a parameter value difference;

a processing parameter selection device, comprising a plurality of preset indicators, each of said preset indicators corresponding to a predetermined parameter value difference, wherein said predetermined parameter value difference and a one of said plurality of predetermined distances corresponds to a predetermined radiation pattern.

2. An audio loudspeaker array system in accordance with claim 1, wherein said parameter is time delay and wherein said parameter value difference is time difference.

3. An audio loudspeaker array system in accordance with claim 1, wherein said parameter is signal magnitude and wherein said parameter value difference is signal magnitude difference.

4. An audio loudspeaker array system in accordance with claim 1, wherein said parameter is phase delay and wherein said parameter value difference is phase difference.

5. An audio loudspeaker array system in accordance with claim 1, wherein said parameter is frequency response and wherein said parameter value difference is a frequency response difference.

6. An audio loudspeaker array in accordance with claim 1, wherein said modules omnidirectional at the frequencies radiated by the loudspeaker array.

7. An audio loudspeaker array system in accordance with claim 1, wherein said modules are directional, and wherein said positioning system fixes the distance between the speaker modules and the orientation between the speaker modules.

8. An audio loudspeaker array system in accordance with claim 1, wherein said positioning system comprises a plurality of spacing brackets that attach to said modules in a manner that said modules are held a fixed distance apart.

* * * * *